United States Patent [19]

Uchida et al.

[11] Patent Number: 4,529,960

[45] Date of Patent: Jul. 16, 1985

[54] CHIP RESISTOR

[75] Inventors: Katsutoshi Uchida; Hisashi Izumida, both of Kashimadai; Kofu Kawana, Miyagi; Masaru Suda, Ishimaki, all of Japan

[73] Assignee: Alps Electric Co., Ltd., Japan

[21] Appl. No.: 614,950

[22] Filed: May 29, 1984

[30] Foreign Application Priority Data

May 26, 1983 [JP] Japan ..... 58-80044[U]

[51] Int. Cl.[3] ..... H01C 1/012

[52] U.S. Cl. ..... 338/309; 219/543; 338/314; 338/327; 338/328

[58] Field of Search ..... 338/211, 212, 308, 309, 338/315, 314, 320, 323, 327, 328, 329, 330, 332; 219/522, 541, 543; 29/619, 620; 428/209, 607; 427/89; 156/656

[56] References Cited

U.S. PATENT DOCUMENTS

| | | | |
|---|---|---|---|
| 3,296,574 | 1/1967 | Tassara | 338/309 |
| 3,441,804 | 4/1969 | Klemmer | 338/308 X |
| 3,849,757 | 11/1974 | Khammous et al. | 338/320 |
| 3,887,893 | 6/1975 | Brandt et al. | 338/295 X |
| 3,904,461 | 9/1975 | Estep et al. | 338/308 X |
| 4,020,222 | 4/1977 | Kausche et al. | 428/209 |
| 4,204,187 | 5/1980 | Kakuhashi et al. | 338/314 X |
| 4,227,039 | 10/1980 | Shibasaki et al. | 338/308 X |
| 4,310,812 | 1/1982 | DeBloois | 338/309 X |
| 4,358,748 | 11/1982 | Gruner et al. | 338/320 X |
| 4,396,900 | 8/1983 | Hall | 338/309 |

*Primary Examiner*—Volodymyr Y. Mayewsky
*Attorney, Agent, or Firm*—Guy W. Shoup

[57] ABSTRACT

A chip resistor provided with a thin-film resistor has lateral electrodes formed at both sides of the substrate of the chip resistor. The lateral electrodes are formed by printing and firing conductive paste of a silver resin, not by thin-film technology. Electrode layers are formed on the lateral electrodes and on the thin-film electrode by plating. The chip resistor is thus constructed so as to be readily connectable to a motherboard by dip soldering or reflow soldering.

2 Claims, 8 Drawing Figures

CHIP RESISTOR

FIELD OF THE INVENTION

The present invention relates to a chip resistor provided with a thin-film resistor and, more particularly, to such a chip resistor which can be produced in an economical manner.

BACKGROUND OF THE INVENTION

Generally, chip resistors produced by thin-film technology have resistance elements exhibiting good characteristics, and variations in quality among the chip resistors are small. Hence, resistors of this kind are used in various electronic apparatuses. According to one method of mounting such a chip resistor equipped with thin-film elements on a motherboard, the resistor is stuck to the motherboard, and electrical connection is made by wire-bonding. In this case, no lateral electrodes are formed.

Referring now to FIGS. 1 (*a*) and 1 (*b*), there is shown a chip resistor provided with thin-film elements of this kind. This resistor includes thin-film electrodes 1, a thin-film resistor 2, and an insulating substrate 3. When the configuration shown in FIG. 1 is connected to a motherboard, an inefficient manual soldering operation is required. This presents serious problems in that it runs counter to the recent trend of the industry where electrical connection of components is made by dip soldering or reflow soldering to improve the efficiency of the operation.

Accordingly, in an attempt to accommodate dip soldering or reflow soldering, lateral electrodes 4' (see FIG. 2) have been sometimes produced by a thin-film technology such as evaporation in a vaccuum, electron-beam evaporation, or sputtering. However, this method is uneconomical.

According to a still other method which is extensively used, films are deposited by printing metalglaze paste or by simlar means, and then the films are fired to form lateral electrodes. This method, however, needs a high temperature for firing operation, thus deteriorating both the low resistance temperature coefficient of the thin-film resistor and the high stability of the resistance which characterize the thin-film resistor.

SUMMARY OF THE INVENTION

In view of the foregoing difficulties with the prior art, it is an object of the present invention to provide a chip resistor having lateral electrodes which can be produced in an economical fashion without using a thin-film technology that tends to increase the manufacturing cost.

It is another object of the invention to provide a chip resistor having a thin-film resistor which can be produced by a simple way without detriment to the excellent characteristics of the thin-film resistor.

It is a still other object of the invention to provide a chip resistor which can easily be connected to a motherboard by dip soldering or reflow soldering.

Other objects and features of the invention will appear in the course of the description thereof which follows.

BRIEF DESCRIPTION OF THE DRAWING

FIG. 1 (*b*) is a cross-sectional view of the resistor shown in FIG. 1 (*a*);

FIG. 2 (*b*) is a cross-sectional view of the resistor shown in FIG. 2 (*a*);

FIG. 3 (*b*) is a cross-sectional view of the resistor shown in FIG. 3 (*a*);

FIG. 4 (*b*) is a view for illustrating one way of forming the lateral electrodes of the resistor shown in FIGS. 3 (*a*) and 3 (*b*).

DETAILED DESCRIPTION OF THE INVENTION

Figure 1A:
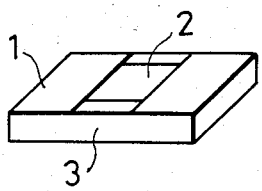
Fig.1(a) PRIOR ART
FIG. 1 (*a*) is a perspective view of a conventional chip resistor.
Figure 1B:
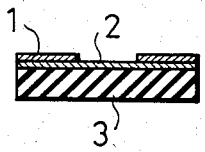
Fig.1(b) PRIOR ART
Figure 2A:
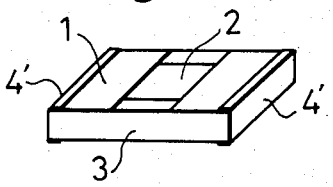
Fig.2(a) PRIOR ART
FIG. 2 (*a*) is a perspective view of another conventional chip resistor.
Figure 2B:
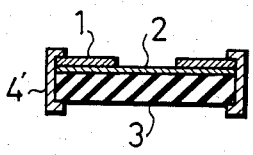
Fig.2(b) PRIOR ART
Figure 3A:
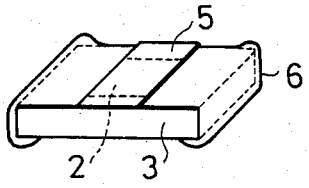
FIG. 3 (*a*) is a perspective view of a chip resistor according to the present invention.
Figure 3B:
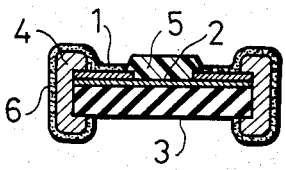

Referring next to FIGS. 3 (*a*) and 3 (*b*), there is shown a chip resistor embodying the concept of the present invention. This resistor has thin-film electrodes 1, a thin-film resistor 2, and an insulating substrate 3 in the same manner as the aforementioned prior art structures. The chip resistor further includes lateral electrodes 4 which cover the lateral sides and the upper and lower end portions of the substrate 3. The electrodes 4 are produced using paste of a silver resin, and are connected to the thin-film electrodes 1. The resistor 2 is covered with an overcoat 5 which is formed by printing resin. Electrode layers 6 which are formed by plating are deposited on the lateral electrodes 4 and on the electrodes 1.

Figure 4A:
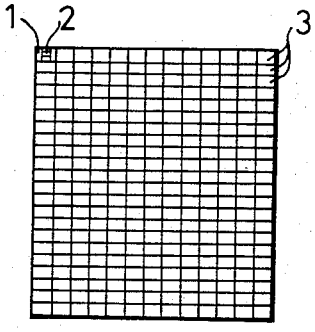
FIG. 4 (*a*) is a view for illustrating the steps of producing the thin-film resistor and the thin-film electrodes of the chip resistor shown in FIGS. 3 (*a*) and 3 (*b*)
Figure 4B:
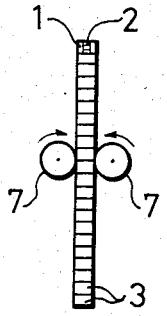

In manufacturing chip resistors constructed as described above, one face of an original substrate is separated into a number of regions by partition lines such that each region corresponds to the above-described insulating substrate 3, as shown in FIG. 4 (*a*). Thin-film resistors 2 and thin-film electrodes 1 are successively formed in position on each substraste 3. Then, the overcoat 5 is printed and fired in such a way that the electrodes 2 are entirely covered with it, but most of each electrode 1 is not covered with it. The original substrate is then cut into long arrays of substrates as shown in FIG. 4 (*b*) along the longitudinal partition lines shown in FIG. 4 (*a*). Subsequently, each substrate 3 is held between a pair of spray rollers 7 to apply conductive paste of a silver resin to both sides of the substrate 3. Then, it is fired to form the lateral electrodes 4. The temperatures at which the overcoat 5 and the lateral electrodes 4 are fired are relatively low, and therefore the characteristics of each thin-film resistor 2 will not deteriorate. After or before the long arrays of the substrates are cut into each individual substrate 3, electrodes 6 are formed on the lateral electrodes 4 and on the electrode 1 by plating to obtain chip resistors as shown in FIGS. 3 (*a*) and 3 (*b*).

Although the lateral electrodes 4 are formed using the rollers 7, it is also possible to form the electrodes 4 by printing or other means while keeping the long arrays of the substrates in a horizontal position.

As thus far described, the invention permits lateral electrodes to be produced by an economical manufacturing method without impairing the characteristics of thin-film resistors. Further, chip resistors fabricated in accordance with the invention can be readily connected to a motherboard by dip soldering or reflow soldering, whereby reducing the cost to manufacture the chip resistors. Thus, the invention yields practically worthy advantages.

What is claimed is:

1. A chip resistor comprising:

a substantially rectangular insulating substrate, a thin-film resistor formed on one side of the substrate, thin-film electrodes at both ends of the thin-film resistor, lateral electrodes of a silver resin which are connected to the thin-film electrodes and are formed by printing and firing so as to cover the side portions of the substrate, and electrodes formed on the lateral electrodes by plating.

2. A chip resistor as set forth in claim 1, wherein the thin-film resistor is entirely coated with an overcoat of a resin.

* * * * *